United States Patent [19]

Quick

[11] Patent Number: 4,534,310

[45] Date of Patent: Aug. 13, 1985

[54] APPARATUS AND METHOD FOR PROCESSING WIRE STRAND CABLE FOR USE IN PRESTRESSED CONCRETE STRUCTURES

[76] Inventor: Nathaniel R. Quick, 13181 Tudor Dr., Carmel, Ind. 46032

[21] Appl. No.: 512,680

[22] Filed: Jul. 11, 1983

Related U.S. Application Data

[62] Division of Ser. No. 242,939, Mar. 12, 1981, Pat. No. 4,439,282.

[51] Int. Cl.[3] ..... B05B 5/02

[52] U.S. Cl. ..... 118/620; 118/67; 118/69; 118/73

[58] Field of Search ..... 118/620, 67, 69, 73

[56] References Cited

U.S. PATENT DOCUMENTS

| | | | |
|---|---|---|---|
| 2,728,696 | 12/1955 | Seyir | 148/6.35 |
| 2,794,630 | 6/1982 | Turner | 148/6.35 |
| 3,125,471 | 3/1964 | Conner | 148/6.35 |

*Primary Examiner*—Sam Silverberg
*Attorney, Agent, or Firm*—Clay Holland, Jr.

[57] ABSTRACT

The apparatus and method for processing steel strand wire cable and the like for use in prestressed concrete is disclosed in which the outer surface of the cable produced has a substantial pure rust or hydrated oxide coating thereon enabling the cable to be utilized immediately in concrete configurations to thereby produce substantially higher flexural strengths in prestressed concrete than heretofore in the prior art. The apparatus and method specifically encompasses the use of ultransonic cleaning equipment which causes cavitation cleaning effects in the liquid medium through which the cable passes during its cleaning process. In effect, the ultrasonic cleaning "catalyzes" the chemical redox reactions by removing all surface inhibitors and reducing reactant diffusion barriers thus accelerating surface wetting of the strand cable with $H_2O$ and $O_2$, such that the rusting chemical reactions can occur spontaneously. The dominant bond developed between the steel and concrete is chemical. The bonding or wetting agent is ferro-orthosilicate, formed by the reaction of pure rust ($FeO.Fe_2O_3$) with silicates ($SiO_2$) in the cement mixture used for making the concrete structure.

3 Claims, 6 Drawing Figures

Fig. 2
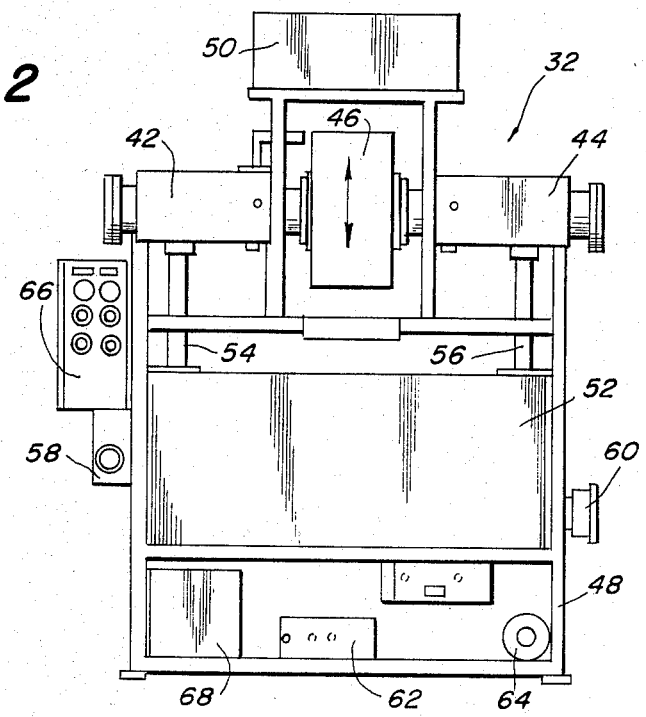
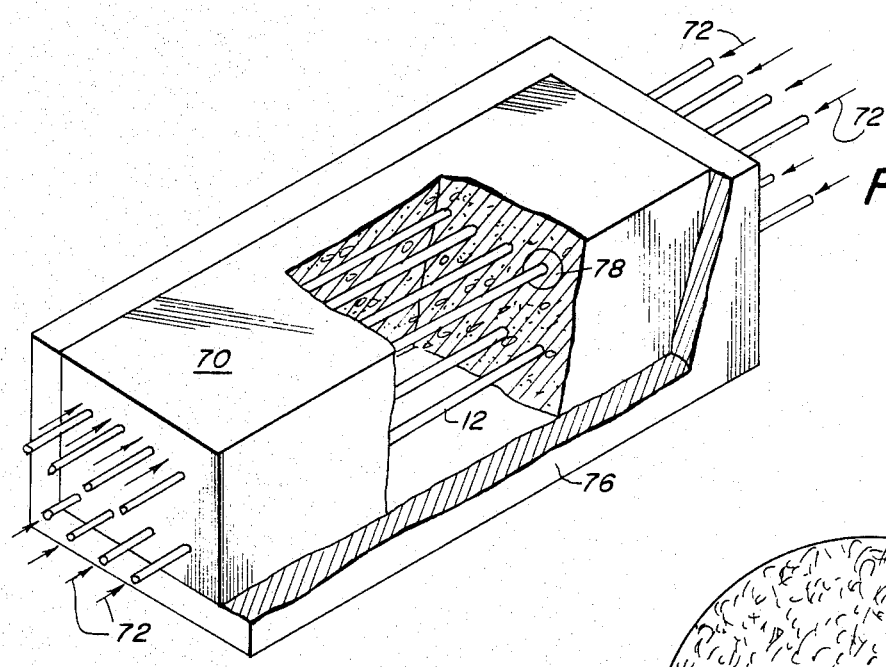
Fig. 5
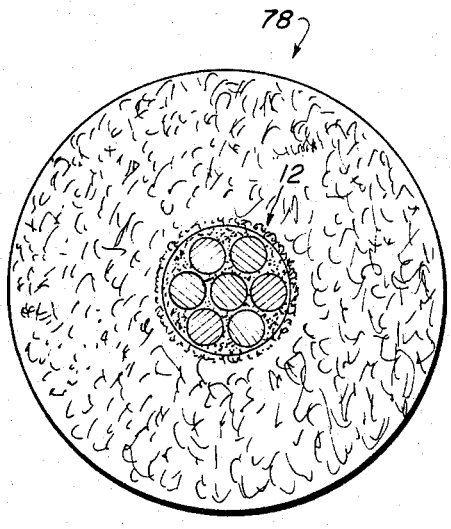
Fig. 6

APPARATUS AND METHOD FOR PROCESSING WIRE STRAND CABLE FOR USE IN PRESTRESSED CONCRETE STRUCTURES

This application is a divisional application Ser. No. 242,939, filed 3-12-81 now U.S. Pat. No. 4,439,282.

BACKGROUND OF THE INVENTION

The present invention relates to apparatus and methods for processing and treating various wires and cables, such as alloys of steel, for such purposes as coating with insulation; for coating metal wire and sheet materials with another metal coating; and for surface treatment of metallic wires and sheets for surface hardness. It also relates to wire and strand cable utilized in prestressed concrete structures.

In the prior art, methods for annealing and oxidizing of wire to remove known and undesirable soap or grease compounds used in drawing the wire to size is removed by heating the wire by passing an electrical current therethrough. Such a process is illustrated in U.S. Pat. Ser. No. 1,993,400, issued Mar. 5, 1935, to W. H. Convers. In the foregoing patent the wire is heated continuously by passing an electrical current therethrough in an air atmosphere to anneal and oxide it at atmospheric temperatures.

In U.S. Pat. Ser. No. 2,300,329, issued Oct. 27, 1942, to W. H. Wood, et al, a wire in continuous operation is heated by its electrical resistance to an elevated temperature and is subsequently passed through a series of molten baths of controlled temperatures and finally quenched in an oil bath before exposure to atmosphere. In another U.S. Pat. Ser. No. 2,310,451, issued Feb. 9, 1943, to W. E. Marshall, a process is disclosed for causing a phosphorus bearing surface to be formed on a sheet, strip or wire and subsequently annealed in a controlled atmosphere of reducing gas. The material is next passed through an acid solution prior to final immersion in a galvanizing pot for final coating. In yet another U.S. Pat. Ser. No. 2,794,630, issued June 4, 1957 to C. A. Turner, Jr., a strip of metal is passed continuously through a furnace heating the strip to an annealing or normalizing temperature, thence into a cooling chamber filled with a protective atmosphere which insures that the surface of the strip is bright when it leaves the chamber. While in the cooling chamber, the strip is cooled to a temperature above which it will not oxidize in the atmosphere. Oxidation of the strip occurs only between the time the strip leaves the cooling chamber and enters the quenching liquid. Thus, oxidation occurs in an air atmosphere during a relatively short distance before it enters the quenching liquid. The quenching step tends to terminate or stop the oxidizing process. The apparent purpose of the oxide coating is to enhance the tinplating or galvanizing process when the strip is used for such purposes. However, it should be noted that one of the primary purposes of the process is to stop the oxiding process rather than to encourage or increase it.

In each of the foregoing prior art and other techniques the primary purpose has been to treat the surface of the metal so that it may be utilized in an application where the metal is covered or encapsulated with another substance or material. However, the foregoing prior art nor any other known prior art has disclosed or revealed an understanding or appreciation for the difficulties to be encountered as a result of the presence of microscopic contaminants on the surface of the metal prior to the formation of the desired or required oxides or coating formed thereon. For example, it is well known that deposits of acid and other cleaning solutions residue in the smallest of cracks or pinholes on the surface of high carbon or low alloy steels, or in the crevices between strands of such steel cables may cause corrosion or contribute to hydrogen embrittlement and stress corrosion cracking of the metal which in turn tends to reduce the tensile and flexural strength of such metals. This is true when the metals are in the form of steel wire, strand cable or rope which is utilized in application of high and often continous stress conditions. The presence of other substances such as calcuim stearate, sodium stearate, zinc phosphate and other phosphorous substances, as examples the formation of oxides with any of these substances present will adversely affect bond development and hence the ultimate tensile or flexural strength of cable or wire reinforced concrete structures and the like owing to their presence.

As further evidence that the prior art failed to appreciate the signifiance of surface contaminants on wire or cables and the like utilized in prestressed concrete reference is made to several prior art patents hereinbelow. In the prior art it is known to fix pretensioned wires or cables and the like into a mold after which fluent concrete is deposited onto and around such wires. Tension is placed on the wires by means of jacks, for example. After the concrete hardens the highly tensioned wires are severed at their point of entrance to the mold whereupon the stress exerted within the wires is imparted to the concrete. The individual contents of each mold are then removed and the process can be then repeated. Various processes for providing tension upon the reinforcing wires may be used in manufacturing prestressed concrete. However, there is no process known wherein advantage is taken of the coating which is formed upon the surface of treated or processed wire, strand cable, rope and the like, to thereby enhance the tensile or flexural strength of the wires utilized in such prestressed concrete structures.

More particularly, it appears that little is known about the bond development which is formed between the concrete and the wire or cable used in prestressed concrete. In fact, it is a practice in some of the prior art particularly for sleepers or railroad ties, to prevent rusting or substantially eliminate any rust from the surfaces of the wire or cable used in the manufacture of prestressed concrete structures for fear of aggressive corrosion. Such efforts clearly demonstrate a lack of understanding or appreciation for the advantages to be derived by the presence of a proper or effective rust coating on the wire or cable used for such prestressed concrete structures.

Referring to U.S. Pat. Ser. No. 3,469,829, issued Sept. 30, 1969, to Makoto Fujita et al, there is disclosed apparatus for producing wire of high tensile strength which is also capable of use in prestressed concrete. Althrough the patent recites as an object the use of the resulting processed wire for prestressed concrete, there is no disclosure of knowledge or appreciation of the need to remove microscopic contaminants which may adversely affect the bond development between the wire and concrete. As noted hereinabove, the Fujita et al patent does not disclose any recognition or appreciation for the desire or need for the presence of a rust on the wire used in the prestressed concrete structures in which their product may be employed. The Fujita patent stresses the benefits of using the high tensile strength properties of the wire produced by their process only.

Referring to another U.S. Pat. Ser. No. 3,647,571, issued Mar. 7, 1972, to Kazuo Okamoto et al, there is disclosed a process for producing low relaxation or low creep characteristic steel for such uses as prestressed concrete structures. Although the patent recites the use of "air cooling", which means natural or forced air cooling, as part of a step in the process, the ultimate objective is to produce a low relaxation property for the material being processed at room and elevated temperatures. No mention or suggestion is disclosed as to the possible difficulties one might encounter by the presence of microscopic contaminants on the metal's surface which would substantially reduce bond development between the wire and cured concrete when the wires utilized are subjected to high tension therein. Here again is an excellent example of a prior art disclosure or teaching which does not recognize and/or appreciate the benefits to be derived from the use of a rust covered wire used in concrete structure. The lack of understanding or appreciation appears to arise from the fact that heretofore little was known about the chemical reaction required for enhanced bond development as disclosed and taught by the present invention.

SUMMARY OF THE INVENTION

In contrast to the various prior art processes and techniques, the present invention is directed to the provision of apparatus and method for processing high carbon and alloy steel wire, strand wire cable, wire rope and the like for use in prestressed concrete structures wherein the outer surface of such wire, cable or rope elements is uniquely coated with substantially pure rust or hydrated oxide. In accordance with the present invention the rust coating on the wires outer surfaces enables it to be utilized immediately in prestressed concrete structures and to experience excellent bond development between the wires and the cured or hardened concrete to provide substantially higher flexural strengths in the concrete structure than heretofore known in the prior art.

The superior properties of rust formed on the surface of the steel in accordance with the present invention is primarily due to the unique surface treatment given to the steel by ultrasonic cleaning prior to formation of such rust or hydrated oxides in atmospheric air. More specifically, the wire under continuous treatment and cleaning process is passed through an ultrasonic cleaning means or apparatus as one step in the process. The ultrasonic cleaning apparatus employs an activated solution which may be a diluted acidic solution. In effect, the ultrasonic cleaning with assistance of the activated solution catalyzes the chemical redox reactions by removing substantially all traces, if not all of the surface inhibitors and reducing reactant diffusion barriers thereon. Once the surface has been thoroughly cleaned in accordance with the present invention it is further quenched with controlled contaminate free water from the constant temperature at which the ultrasonic cleaning occurs and is then exposed to air for immediate commencement of controlled rusting in air by the natural process of oxidation with residue microscopically thin water film which wets the entire surface of the wire, cable and the like. Owing to unusually clean surface conditions of wire after ultrasonic cleaning it is possible to produce the unusually thin layer of water on the surface of the wire which is utilized in the reaction necessary to form the hydrate oxide or rust thereon as the wire or cable enter the air atmosphere.

Further, in accordance with the present invention, it has been determined that the substantially enhanced bond development between the cured concrete and rust coated wire is the result of a little known or understood chemical reaction therebetween. More specifically, it has been found that excellent bond development occurs between the concrete and wires when bonding or wetting agent is ferro-orthosilicate resulting from the chemical reaction of pure rust ($FeO \cdot Fe_2O_3$) and silicates ($SiO_2$) in the cement used commercially which is readily available. The prestressed concrete structures which have been produced and used in the railroad industry utilizing strand cable of high carbon steel and various alloy steels have resulted in the making of concrete prestressed structures such as eight foot long railroad ties having consistently withstood bonding strength tests of 100 to 120 KIPS (thousand inch pounds stress) in comparison with similar prestressed concrete structural configurations which used strand cable processed in accordance with prior art processing techniques experienced irradic test results and all failed at a maximum bonding strength of 78 KIPS.

It is therefore an object of the present invention to provide an apparatus and method for economically producing steel wire, strand cable, rope and the like having a substantially pure rust or hydrated oxide coating on such members.

Another object of the invention is to produce a steel wire strand cable, rope or the like which is uniquely adaptable and particularly useful and suited for use in prestressed concrete structures.

Yet another object of the present invention to provide a method for producing a prestressed concrete structure and the structure itself wherein the bond development between the steel wire, strand cable, rope and the like of such structures is based upon the formation of ferro-orthosilicate interstitial layer resulting from a chemical reaction between wire and concrete upon the curing of the concrete.

Still a further object of the present invention is to provide a process which may be used with practical high speed industrial manufacturing systems for producing strand cables and the like.

Yet a further object of the invention is to provide a method and product useful for manufacturing prestressed concrete structure of enhanced flexural strengths.

The above and further objects and features of the present invention will become apparent from the following description and claims when taken in conjunction with the accompanying drawings.

BRIEF DESCRIPTION OF THE DRAWINGS

The realization of the above features and advantages along with others of the present invention will be apparent from reference to the accompanying drawings in which:

FIG. 2 is an enlarged view of the ultrasonic cleaning apparatus shown in FIG. 1;

FIG. 5 is a diagrammatic isometrical view, partly in section, of a railroad tie in a castingmold illustrating a plurality of strand cables under tension during the curing of the concrete encapsulating the strand cable; and FIG. 6 is a fragmentary section of the concrete structure shown in the encircled area of FIG. 5, illustrating the steel wire cable and an interstitial layers formed between the strands of a typical cable and the cured concrete.

Figure 1:
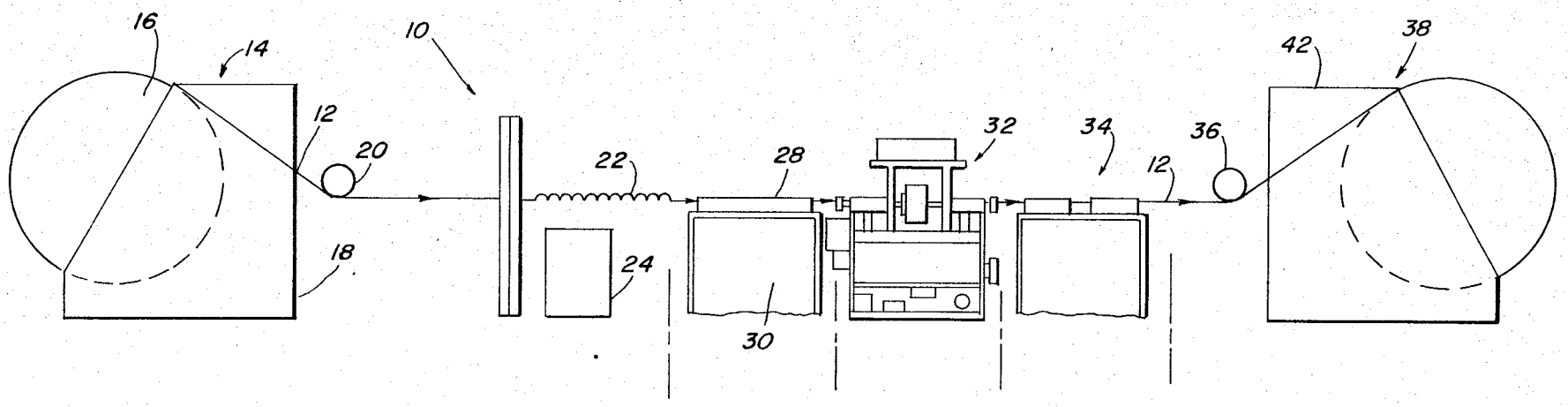
FIG. 1 is a diagrammatic view of a preferred embodiment of apparatus utilized for producing a rust surface on strand cable.

With reference now to the drawings, wherein like or corresponding parts may be designated by the same reference characters throughout the several views, there is shown in FIG. 1 a diagrammatic view of an embodiment of the system, generally referenced by character designated 10, utilized in accordance with the present invention. Apparatus 10 comprises a series of inline devices which cooperate with each other to produce a continuous flow of steel cable wire strand cable 12 which will ultimately have its entire surfaces coated with substantially pure rust, characterized as hydrated oxide of steel. Such rust may be formed on high carbon steel or other steels containing predetermined low amounts of other alloying substances.

As shown in FIG. 1, apparatus 10 comprises a pay-off reel 14 including a large diameter drum 16 which is supported on a stand 18. The pay-off reel initially contains the cable 12 wound thereon which is fed therefrom as the cable 12 passes along a prescribed path while being processed by the system. The cable is fed under a guide roller designated 20 to an electrical heat induction coil 22 which is utilized to heat the transversing cable to a preselected elevated temperature. In practical applications the temperature of the travelling cable is elevated to a temperature in the range of 650° F. to 750° F. The temperature of the cable is maintained within the selected range by a voltage/current regulation device 24 including temperature controlling mechanism, as the cable passes through coil 22 at various selected speeds. In practice, it has been found that the system will operate satisfactorily at speeds of 150 to 300 feet per minute. The limitations in speed are related to the size of the motor utilized to operate pay-off reel 14 and a take-up reel 26. The motors utilized for unreeling and re-reeling the cable are not shown, however, such motor arrangements are well known in the art and are readily available commercially and therefore deemed unnecessary to be shown.

Continuing with the description of the system, after the heated cable leaves the induction heating coil 22 it is fed to a pre-quenching device 28 including a tank system and appropriate controls which is adapted to allow the cable to pass therethrough, and during the process of passing to quench the same through the use of internally contained jet liquid spray devices utilizing circulating liquids, such as water as an example, for cooling purposes. The temperature of the travelling cable is lowered significantly to a temperature range of 180° F. to 200° F. as it passes through the quenching device. The liquids utilized in the cooling process are recirculating, filtered and cooled by tank system 30 designed and adapted for operation in accordance with this invention.

After passing through pre-quenching device 28, cable 12 is received along its prescribed path by an ultrasonic cleaning device 32. Ultrasonic cleaning device 32 provides high speed continuous surface and deep crevice cleaning of cable 12 as it passes therethrough. The temperature of the cable is maintained at pre-selected temperature close to the temperature cable 12 has on existing from pre-quenching device 28. Details of the cleaning process will be discussed in connection with FIG. 2.

Upon completion of the cleaning process in cleaning device 32, cable 12 passes to an inline post-quenching tank 34 where the cable is subjected a final quenching process which lowers the temperature of cable 12 to standard room temperature of at least 72° F. The cable exits from post-quenching tank 34 into air where it immediately commences a hydrated oxidizing process which produces a substantially pure rust on all wetted surfaces of the strand cable as an integral part of its surfaces.

As shown in FIG. 1, the cable is next passed under an exit roller 36 and onto a take-up reel 38 including a drum 40 upon which cable 12 is wound. Drum 40 is supported by a take-up stand 42.

Referring now to FIG. 2, there is shown an enlarged and more detailed view of ultrasonic cleaning apparatus 32 shown in FIG. 1. Ultrasonic cleaner 32 includes an infeed vestibule 42 and an outfeed vestibule 44 patterned on flood box techniques to allow straight in-line cable feed therethrough. Such techniques eleminate cable bending and liquid leakage as it passes through the apparatus. Disposed between said vestibules is an in-line cylsonic cylindrical transducer 46 for focused high power density ultrasonic cleaning along the path of travel of the cable. The components of the cleaning device are mounted on a common frame 48. The device further includes a generator 50 for generating high frequency power for driving transducer 46. In practice, the transducer is driven at the rate of 20 kHz. Disposed beneath in-line vestibule-transducer arrangement is a storage tank 52 for holding and conditioning a solution, which may be water base solution of 2% RSF 142 for example, in the preferred embodiment. However, other mild acidic or cleaning solutions may be used. Selection of the solution is dependent upon the adherence strength and species of the surface contaminates and the corrosion/hydrogen embrittlement susceptibility of the transducer materials to the chemicals involved in such cleaning.

Liquid cleaning solution from storage tank 52 is circulated through transducer 46 by means of an inlet pipe 54 connected between vestibule 42 and tank 52, and an outlet pipe 56 connected between vestibule 44 and tank 52. The temperature, liquid level and recycling of the liquid cleaning solution is controlled respectively by a thermostat device 58 and an electrical immersion heater 60 in storage tank which is not shown in its entirety; a liquid leveling device 62; and pump 63 and an electrical control box 64.

A similar cleaning apparatus of the type disclosed herein is available as a cylsonic cleaning unit, manufactured by Westinghouse Electric Corporation, U.S.A. However, the apparatus disclosed by the present invention has been adapted to accommodate the use of dilute acid solutions for cleaning the high carbon and low alloy steels utilized to make prestress concrete tie structures in accordance with the present invention. Prior to the present invention it was believed by the manufacturer of the equipment that the ultrasonic apparatus would not tolerate the use of acid solutions, particularly as applied to the transducer. Thus, the transducer was adapted by the use of 316 or Carpenter 20 stainless steel as part of the cylinder chamber for transducer 46. Other non-pitting or non-corrodin alloys may be used for construction of transducer 46.

Other fittings, piping and the like of the system were also adapted by the use of certain acid resistance materials. In addition to material substitutions within the system, it was discovered that practical results were obtainable with the use of dilute solutions of RSF 142, a commercially available acid mixture containing florides and chlorides and certain inhibitors, available from Arrow Chemical Corporation, a U.S. corporation The electrical power to the apparatus is controlled by a transformer 68 and a control box 66.

Figure 3:
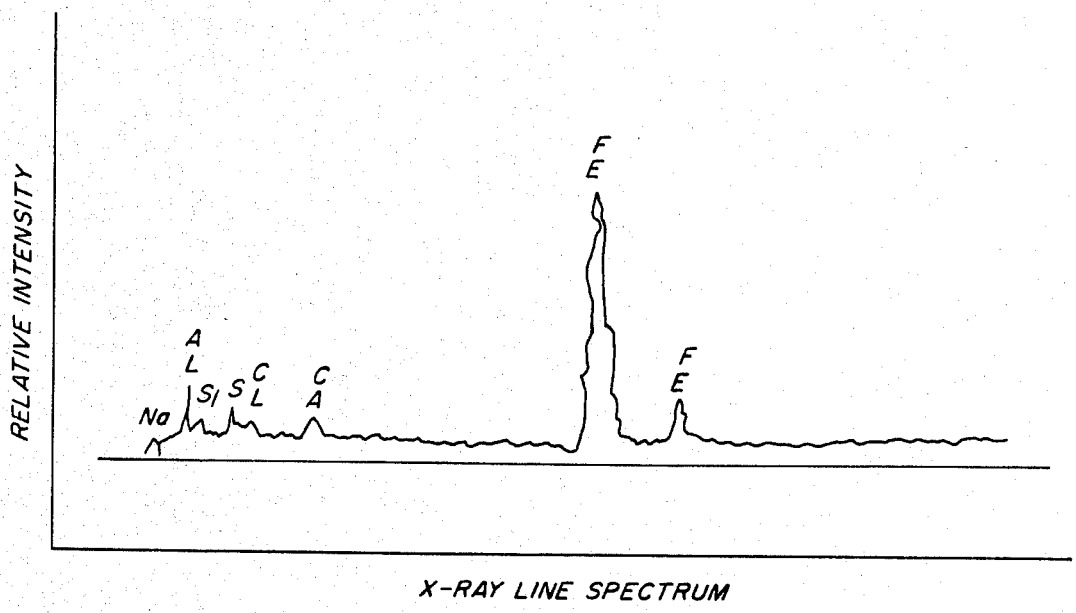
FIG. 3 is a drawing of a SEM/EDX analysis of 1080 AISI steel strand wire cleaned with traditional prior art techniques, illustrating the presence of significant surface inhibitors and contaminants after such cleaning.

Referring now to FIG. 3, there is shown a drawing of a scanning electron microscope/energy dispersive X-Ray (SEM/EDX) analysis of 1080 AISI steel; illustrating relative intensity versus X-Ray line spectrum for the various chemical elements found on the surface of the strand cable after cleaning with traditional prior art processing techniques. As shown in the drawing, the line spectra for sodium, aluminum, silicon, sulfur, chloride, and calcium are present as predominantly surface elements. Upon further examination of the surface of the cable with these chemical elements thereon, it was found that they are generally found in the form of sterates.

Figure 4:
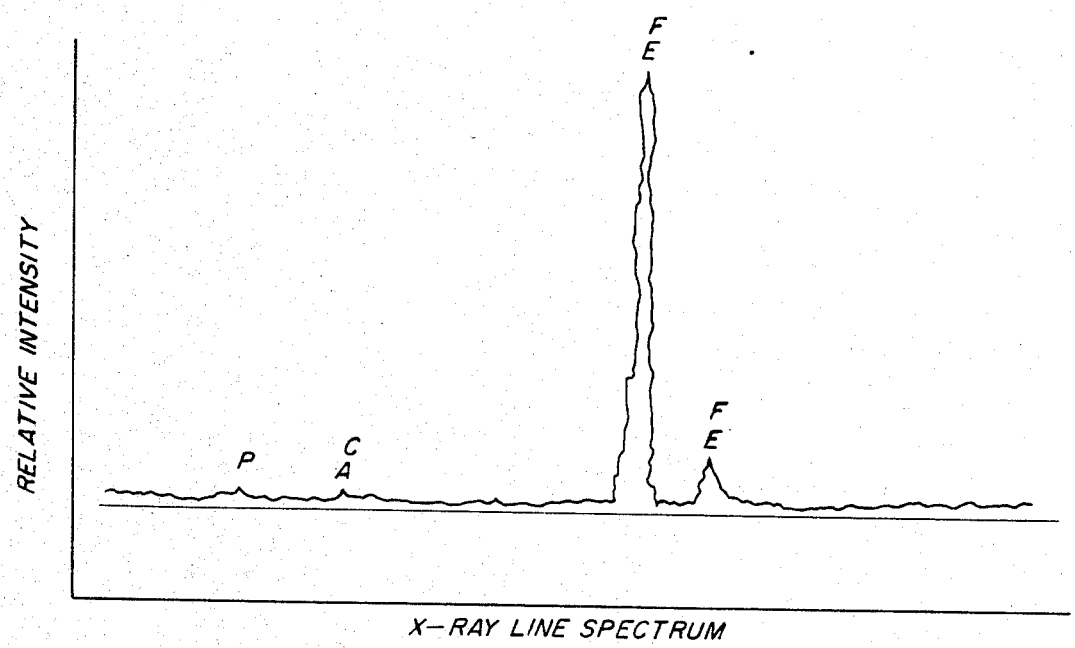
FIG. 4 is a drawing of a SEM/EDX analysis of 1080 AISI steel strand wire cleaned with the apparatus disclosed and claimed in accordance with the present invention, illustrating the near absence of any surface inhibitors and contaminates after such cleaning.

In comparison with reference to FIG. 4, there is a presentation which shows that substantially all of the contaminants and inhibitors have been removed as a result of the use of the apparatus and processing techniques in accordance with the present invention.

Referring now to FIG. 5, there is shown another embodiment of the invention wherein a prestressed concrete structure 70, for example, a railroad tie, is depicted wherein a plurality of steel strand cables are utilized therein which have surface rust of the type disclosed and taught by the present invention. As shown in the drawing, strand cable 12 is depicted as being in compression by arrows 72 and 74 at opposite ends of the cable, which are directed toward cable strands 12 of tie 70 which is held in a mold 76 to thereby prestress the structure. During the curing of the concrete, the strand cables are pretensioned at a preselected level and the tension relieved after curing of the concrete.

In accordance with the present invention, it has been found in connection with production practices employed in the manufacture of railroad ties that complete and adequate hydrated oxidation of cable 12 takes place in less than 24 hours and that curing of the concrete and the formation ferro-orthosilicate interfacial layers between the strands of cable and concrete occurs in less than 2 days. Additional curing of the concrete up to 6 days resulted in what appears to be maximum curing and bond development within the structure. Thus, less than three days is required to manufacture an improved high strength flexural prestressed structure in accordance with present invention. Also shown in FIG. 5 is an encirculed section 78 of the cable and surrounding concrete.

Evaluation tests of railroad ties having a truncated cross-section of less than one hundred square inches and eight feet in length containing eight strand cables built in accordance with the teaching of the present invention were found to yield bond strength of 110 KIPS (thousands (K) pounds (P) per inches (I) squared (S)) before showing bond failures and demonstrated consistent crack detection strengths of 80 KIPS, as an average, as compared with prior art prepared ties which irradically demonstrate no greater than 78 KIPS and 57 KIPS for bond and crack detection failures, respectively.

The unexpected and outstanding improvements received through the use of the present invention may more readily be understood and appreciated by further explanation with reference to FIG. 6. As shown in FIG. 6, an enlarged fragmentary view of encircled area 78 shown in FIG. 5, there is illustrated showing the formation of the ferro-orthrosilicates between the strands of the cable and the cured concrete. As shown, the surface of each strand of the cable 12 has chemically reacted with the silicates in the fluent concrete during the curing process such that the cable is encapsulated and integrally in bond development with the concrete.

Close examination of FIG. 6 reveals that the entire surface of the cable has entered into the chemical reaction and explains why the concrete structures in accordance with the present invention exhibits such improved and unique properties and characteristics when tested for crack detection and bond development.

The foregoing explanations represent the best understanding available to show the relationship and has been discussed with recognized authority in the field on the subject, such a person as Professor R. Spinna, Chairman of the Department of Civil Engineering, Manhattan College, New York, N.Y., U.S.A. While confirmation of the test results have been provided by means of independent test conducted by Santa Fe/San Vel, Lonestar Company, Littleton, Mass., U.S.A.

For a better understanding of the relationship between the ultrasonic cleaning of strand cable surfaces, formation of rust surfaces and bond development mechanism, a brief review is setforth below. As noted, during presentation hereinabove the process for preparation of the cable has been disclosed wherein five steps are present, namely—pre-heating, initial quenching, ultrasonic cleaning, post-quenching, and finally surface oxidation. In the description the heating of the cable for stress relief assumes that the cable had not previously stress relieved. If a stress relieved wire is utilized, the initial heating of the cable is at a substantially lower temperature than the 650° F. to 750° F. disclosed earlier. The initial temperature may be about 200° F., which would require only slight cooling during the pre-quenching cycle, since the temperature of cable upon entering the ultrasonic cleaning apparatus should be around 180° F. to 200° F. This lower temperature range is maintained substantially constant by the cleaning apparatus.

The actual cleaning process may be characterized as a combination of mechanical scrubbing from cavitation effects and chemical by the liquid mediums dissolving soluable solids while imploding away insoluable solids. Stated in another manner, the ultrasonic device catalyzes chemical re-dox reactions or secondary reactions by removing of surface inhibitors and reducing reactant diffusion barriers thus accelerating surface wetting with water when the cable passes through the final or post-quenching step. In practice, the final quench is done with water such that surfaces of cable 12 have water and traces of oxygen which when combined in an air atmosphere accounts for the spontaneous chemical reaction resulting in rust formation or the formation of hydrated oxides.

The cavitation process noted above is the generation of millions of microscopic voids that implode throughout the liquid medium. These voids are produced by the negative half pressure cycle of the ultrasonic device in longitudinal waves where pressure in the liquid is reduced to less than the pressure of the liquid. The positive half of the pressure cycle causes the voids to implode. Before closing, it should be noted that an activated solution of 2% RFS 142 was found to be adequate. However, it should be understood that significantly stronger solutions of RFS 142 may be utilized, up to 50%, as a practical application.

In closing, it is useful to summarize some of the advantages of the present invention. One such advantage involves the effective removal of contaminants and inhibitors such as wire drawing compound calcium stearate, water insoluble stearates and other materials which may be retained on the surface of the cable as a result of the induction heating for stress relieving the cable, where the applied heat at elevated temperatures promote surface flow of certain of the contaminants causing a glazed surface which tends to seal in various contaminants and/or inhibitors. Thus, the present invention cleaning technique obviates the occurence of the foregoing.

Another advantage of the present invention arises from the fact that a properly and adequately cleansed surface condition on the cable will readily enable it to be wetted by a microscopic layer of water which creates a condition on the cable which will cause hydrate oxide or rust thereon immediately upon being exposed to atmospheric air.

Still another advantage arises from the fact the rust developed on the surface of the cable will chemically react with the silicates in the concrete mixture during its curing process to form a structurally strong bond development in the form of a interstitial layer between the cable and concrete in the form of ferro-orthosilicate.

Yet a further advantage arises from the use of cable processed in accordance with the present invention to produce prestressed concrete structures, such as railroad ties, which have unusually high flexural strengths.

A further, advantage arises from the fact that the system may be adapted to utilize additional ultrasonis transducers which produce cavitation for activated quenching and cooling as an alternative to jet spray rinsing and for increased cable throughput cleaning.

Finally, another advantage arises from the fact that the process disclosed and claimed herein is readily useful for large scale production techniques where cable of lengths in excess of 22,000 feet may be processed at the rate of at least 150 feet per minute to thereby produce rust convered on the cable which is immediately useful in concrete structure.

While the present invention has been described with reference to only one type of strand cable and a railroad tie concrete structure, it is to be understood that alterations and modification may be made in the process and application shown or discussed without departing from the spirit and scope of the invention. Accordingly, it is expressly understood that the foregoing description shall be interpreted only as illustrative of the invention and that the spirit and scope of the invention is to be limited only by the appended claims when accorded the broadest interpretation consistent with the basic concepts taught herein.

What is claimed as new is:

1. An improved apparatus for producing a steel wire strand cable having a substantially pure rust coating on all surfaces thereof comprising, in combination:

(a) a pay-off reel means and a take-up reel means for a wire strand cable which is passed continuously from said pay-off reel along a prescribed path through a series of in-line devices to said take-up reel at a predetermined speed;

(b) an induction heating means located in-line with and between said pay-off and take-up means for applying heat thereto as said cable passes therethrough, whereby said cable is elevated to a predetermined temperature in passing;

(c) pre-quenching means in-line with said heating means for receiving said heated cable and for rapidly quenching said cable to a preselected lower temperature with a liquid as said cable passes through said pre-quenching means along said prescribed path;

(d) an ultrasonic cleaning means in-line with said pre-quenching means for continuous ultrasonic surface and deep crevice cleaning of said cable by means of high frequency cavitation action induced in a liquid coupling medium generated by a magneto-restriction component of said ultrasonic cleaning means through which the cable passes, said liquid being maintained at a preselected temperature and pressure; and (e) a post-quenching means in-line with said ultrasonic cleaning means for further lowering the temperature of said cable as it exits from said post-quenching means to air along said prescribed path to said take-up reel, whereby said cable commences immediately upon leaving said post-quenching means to have said rust formed on the entire surfaces of said cable as it travels in air toward said take-up reel which rotates at a continuous preselected rate during operation of said improved apparatus.

2. The improved apparatus of claim 1, wherein said liquid coupling medium is further defined as a 2% RSF 142 water diluted acid solution.

3. The apparatus defined in claim 1, wherein said liquid coupling medium is further defined as a water solution of RSF 142 acids and inhibitors.

* * * * *